US009311797B2

(12) United States Patent
Yang

(10) Patent No.: US 9,311,797 B2
(45) **Date of Patent: *Apr. 12, 2016**

(54) EAS TAG FOR BOTTLES

(71) Applicant: Xiao Hui Yang, Saratoga, CA (US)

(72) Inventor: Xiao Hui Yang, Saratoga, CA (US)

(73) Assignee: WG Security Products, Campbell, CA (US)

( * ) Notice: Subject to any disclaimer, the term of this patent is extended or adjusted under 35 U.S.C. 154(b) by 51 days.

This patent is subject to a terminal disclaimer.

(21) Appl. No.: 13/964,005

(22) Filed: Aug. 9, 2013

(65) Prior Publication Data

US 2013/0321153 A1 Dec. 5, 2013

Related U.S. Application Data

(63) Continuation-in-part of application No. 13/719,496, filed on Dec. 19, 2012, now Pat. No. 8,890,694, which is a continuation-in-part of application No. 13/614,208, filed on Sep. 13, 2012, now Pat. No. 8,421,633, which is a continuation of application No. 12/754,031, filed on Apr. 5, 2010, now Pat. No. 8,269,631.

(51) Int. Cl.

| | |
|---|---|
| ***G08B 13/14*** | (2006.01) |
| ***G08B 13/24*** | (2006.01) |
| ***E05B 73/00*** | (2006.01) |

(52) U.S. Cl.

CPC ..... *G08B 13/2434* (2013.01); *E05B 73/0041* (2013.01)

(58) Field of Classification Search

CPC ..... G08B 13/2434; G08B 13/2448; G08B 13/248; E05B 73/0041

USPC ..... 340/572.1–572.9, 539.1, 568.1, 539.13, 340/426.1, 542, 545.6, 545.1, 549

See application file for complete search history.

(56) References Cited

U.S. PATENT DOCUMENTS

| | | | |
|---|---|---|---|
| 2,093,688 | A | 9/1937 | Smith |
| 7,134,302 | B2 | 11/2006 | Gorst |
| 7,259,674 | B2 | 8/2007 | Marsilio et al. |
| 7,266,979 | B2 | 9/2007 | Belden, Jr. |
| 7,397,375 | B2 | 7/2008 | Marsilio et al. |
| 7,458,241 | B2 | 12/2008 | Belden, Jr. |
| 7,463,152 | B2 | 12/2008 | Marsilio et al. |
| 7,486,190 | B2 | 2/2009 | Marsilio et al. |
| 7,492,263 | B2 | 2/2009 | Marsilio et al. |
| 7,492,264 | B2 | 2/2009 | Marsilio et al. |
| 7,492,265 | B2 | 2/2009 | Marsilio et al. |

(Continued)

*Primary Examiner* — Daniel Previl

(74) *Attorney, Agent, or Firm* — Waters Law Group, PLLC; Robert R. Waters; Brian W. Foxworthy

(57) ABSTRACT

An anti-theft device monitors bottles. It is comprised of a two components hingably connected together. They can move from an open position to a closed position to enclose the neck of a bottle. One component has a first latch element and contains electronics including an arming switch. The other component has a second latch element. The latch elements combine to hold the two components in the closed position. When the two components are moved to the closed position, and a bottle is in position, the bottle changes the state of the arming switch. One of the components, or both, may have a protrusion that engages a feature on the bottle to keep the tag in place on the bottle. The anti-theft device may be armed or disarmed by remote devices. The latching elements may be releasably lockable such as by a magnet. The anti-theft device may have passcode protection capabilities.

15 Claims, 5 Drawing Sheets

(56) References Cited

U.S. PATENT DOCUMENTS

| | | | | |
|---|---|---|---|---|
| 7,498,944 | B2 | 3/2009 | Marsilio et al. | |
| 7,498,945 | B2 | 3/2009 | Marsilio et al. | |
| 7,570,161 | B2 | 8/2009 | Necchi | |
| 7,602,297 | B2 | 10/2009 | Marsilio et al. | |
| 7,866,497 | B2 | 1/2011 | Belden, Jr. | |
| 8,152,009 | B2 | 4/2012 | Hulin | |
| 8,269,631 | B2 * | 9/2012 | Yang | 340/572.1 |
| 8,368,537 | B2 | 2/2013 | Zhang et al. | |
| 8,421,633 | B2 | 4/2013 | Yang | |
| 8,482,414 | B2 | 7/2013 | Leyden et al. | |
| 2005/0237205 | A1 | 10/2005 | Gorst | |
| 2007/0285243 | A1 * | 12/2007 | Feibelman | 340/572.1 |
| 2008/0291025 | A1 * | 11/2008 | Perez et al. | 340/572.1 |
| 2010/0005840 | A1 * | 1/2010 | Hogan et al. | 70/63 |
| 2010/0315237 | A1 | 12/2010 | Yang | |
| 2012/0151974 | A1 | 6/2012 | Zhang et al. | |
| 2012/0152883 | A1 | 6/2012 | Zhang et al. | |

* cited by examiner

EAS TAG FOR BOTTLES

CROSS REFERENCE TO RELATED APPLICATIONS

This application is a continuation-in-part application based on U.S. patent application Ser. No. 13/719,496 filed on Dec. 19, 2012, which itself is a continuation-in-part application based on U.S. patent application Ser. No. 13/614,208 filed on Sep. 13, 2012 which has issued as U.S. Pat. No. 8,421,633. U.S. Pat. No. 8,421,633 is a continuation of U.S. patent application Ser. No. 12/754,031, filed on Apr. 5, 2010. U.S. patent application Ser. No. 12/754,031 has issued as U.S. Pat. No. 8,269,631. The entire disclosures contained in U.S. patent application Ser. No. 13/719,496, U.S. patent application Ser. No. 13/614,208, and U.S. patent application Ser. No. 12/754,031, and any respective U.S. Patents, including the attachments thereto, are incorporated herein by reference.

FIELD OF INVENTION

The present application is generally related to an anti-theft tag, and more specifically, an anti-theft tag that attaches to wine bottles or other similar bottles. Also, the tag of the present application may be used with various electronic article surveillance (EAS) systems, including for example, an EAS system utilizing tags and deactivators featuring wireless communication for deactivation and alarming, and featuring dynamic time based passcode modification and other tamper resistant features, and/or an EAS system using passive element technology. In certain applications the mere presence of the tag may be deemed to be sufficient deterrence from theft and in those applications the anti-theft tag may actually not have any EAS electronics.

BACKGROUND OF THE INVENTION

Theft is a major concern for retail operations. While electronic article surveillance (EAS) systems are in wide use, it is still necessary to adapt the individual monitoring elements, or tags, to specific variations of protected products, including bottled products. Wine, for example, is a bottled product that can easily be valuable enough to justify the use of EAS technology to prevent theft. Embodiments of the present invention are capable of attaching to wine bottles and other bottles of similar shape and configuration.

SUMMARY OF EMBODIMENTS OF THE INVENTION

The present invention is for an anti-theft electronic article surveillance tag having a first and second component hingably attached to each other. The two hinged components can move from the many open positions of an open state to the closed position of a closed state. When in the closed position the two components combine to form a passageway which can close around the next of a wine bottle, or similar bottle. The first component has a housing and a first latching component. The second component has a second latching component. When the first and second components are in the closed position, and the first and second latching components are engaged, the latching components keep the first and second components in the closed position. The latching components are releasable so that the anti-theft tag may be removed from an object by an authorized person. The housing may also contain a blocking component to lock the latching components in position to prevent them from being disengaged without authorization. This blocking component is releasable as well.

The housing contains an internal compartment which holds several electronic components. Among the electronics components is an arming switch. The housing has an aperture through it and the arming switch protrudes through this aperture to extend out into the passageway formed by the first and second components when they are in the closed position. When the two components are in the closed position and a bottle neck is in the passageway, the bottle neck changes the state of the arming switch. This change in state of the arming switch is recognizable and usable by the other electronics components.

Among the other electronics which may be contained in the electronics compartment of the housing of the anti-theft tag are: a microprocessor, a circuit board, a battery, a passive EAS element, a latch switch, an audible alarm producing device, light emitting diodes, and communication elements including wireless communication elements such as radio frequency, optical (infrared), or other communication elements. The microprocessor or circuit board can detect when the arming switch undergoes a change in state. If the electronics also comprise a latch switch associated with the latching elements, the electronics monitor the latch switch for the latched or unlatched status of the tag. If the change in state of the arming switch indicates that a bottle neck is present in the passageway, the tag may be armed. In some embodiments, the EAS tag may be armed with an external device that communicates with the tag via the communication elements such which may be wireless optical infrared communication elements, wireless radio frequency communication elements, or other communication elements. In some embodiments, the latch switch detects when the latch has been engaged and the combination of the arming switch and the latch switch arms the electronics. The external device can be a hand held remote communication device or a device associated with a base station.

Once armed, if the electronics detect an unauthorized change in status, the electronics can determine an alarm condition and issue an alarm. For example, if a tag is removed from a protected bottle, and the bottle neck is removed from the passageway, the status of the arming switch will change. If an authorization signal is not previously received by the tag, the electronics will determine an alarm condition and issue an alarm. This alarm may be an audible alarm or an alarm broadcast to a respective receiver in an electronic article surveillance anti-theft system. The broadcast may be by infrared communications, radio frequency communications, or other wireless type communications.

Disarming of the EAS tag may be accomplished by authorized personnel. An authorized person having access to other elements of the EAS system such as a hand held communication device or a base station having communication capabilities may disarm the device. Some embodiments will add another element of security with passcode capabilities in the respective electronics. The EAS tag electronics of these embodiments are capable of storing a passcode which is known to the communication elements of the EAS system and which can be used to confirm to the EAS tag that the disarming signal is authorized. A further element of security can be added by using clock based algorithms to change the passcode synchronously. In those embodiments, the EAS system and the EAS tag both have clock generators and are programmed with the same algorithm and both are programmed with the same initial passcode. As time passes, the algorithm alters the passcode at preset intervals as regulated by the clock generators. This changing passcode further complicates unauthorized attempts to disarm the EAS tag. If an EAS tag is detached without being disarmed with the appropriate passcode, the EAS tag will detect an alarm condition and generate an alarm.

To physically prevent the release of the latch and the detaching of the housing portion from the base portion, a blocking component or mechanism may be employed. In one embodiment, a biased blocking member moves into a blocking position when the first and second latching components engage between the first and second latching components. The biased blocking member has a magnetically attractable element associated with it, and when a magnet is applied to the EAS tag, the biased blocking member moves to a position where it no longer blocks the release of the latching components. If a magnet is used to detach an EAS tag without authorization and the EAS tag is still armed, the electronics detect an alarm condition and generate an alarm. In some embodiments a magnet may be built into a communication device so that the EAS tag may be disarmed and its latch released for detachment using the same device.

BRIEF DESCRIPTION OF DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS OF THE INVENTION

Figure 1:
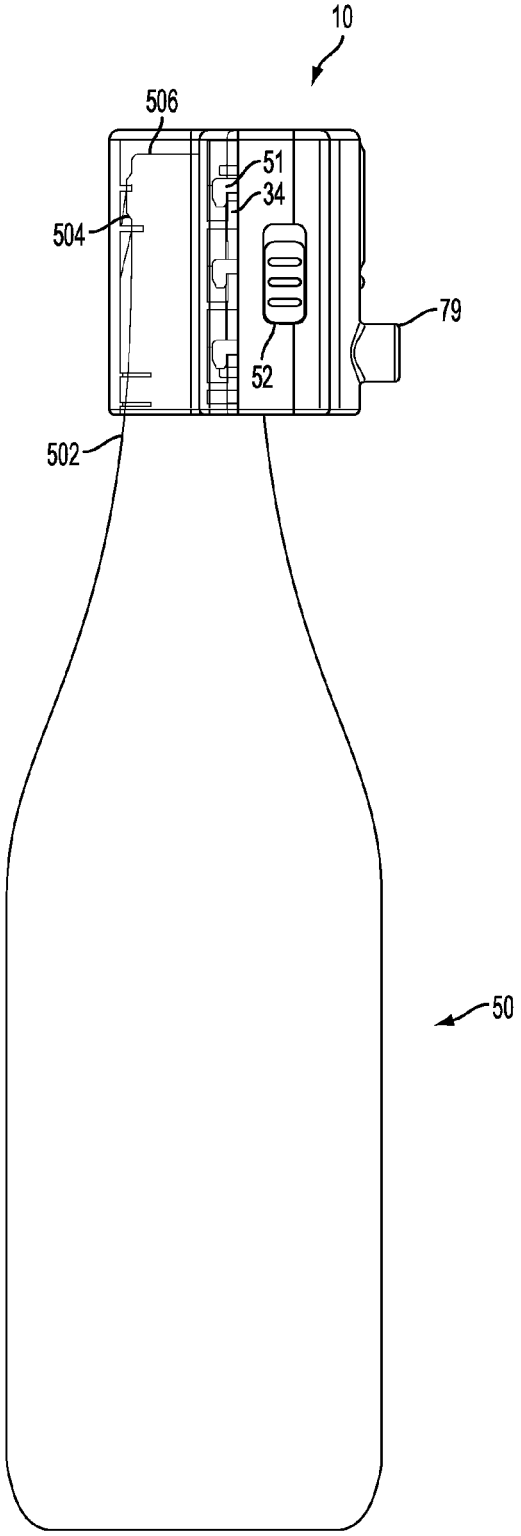
FIG. 1 shows an embodiment of an anti-theft tag of the present invention from one side closed around the neck of a bottle to be protected.

FIG. 1 shows an embodiment of an anti-theft tag 10 of the present invention from one side closed around the neck of a bottle 500 to be protected. Bottle 500 may be a wine bottle or other bottle having a bottle neck 502 and an annular feature 504 around its neck 502. Tag 10 in FIG. 1 is comprised of a first component 20 and a second component 30 hinged together. First component 20 and second component 30 can move between a myriad of open positions and a closed position. When in the closed position, tag 10 forms a cavity or passageway for fitting around neck 502 of bottle 500. In the embodiment of FIG. 1, second component 30 is made of transparent material and part of bottle 500 is visible through second component 30.

Neck 504 is of a size that anti-theft tag 10 can accommodate. Annular feature 504 may take several forms. Annular feature 504 may be: an increase in diameter of neck 502 which starts proximal to end 506 of bottle 500 and continues to end 506; an increase in diameter of neck 502 which starts proximal to end 506 of bottle 500 and returns to the nominal diameter of neck 502 before end 506, i.e. a raised ring; or, a recessed ring proximal to end 506 of neck 502 of bottle 500. In FIG. 1, annular feature 504 is a raised ring around neck 502 of bottle 500.

Figure 2:
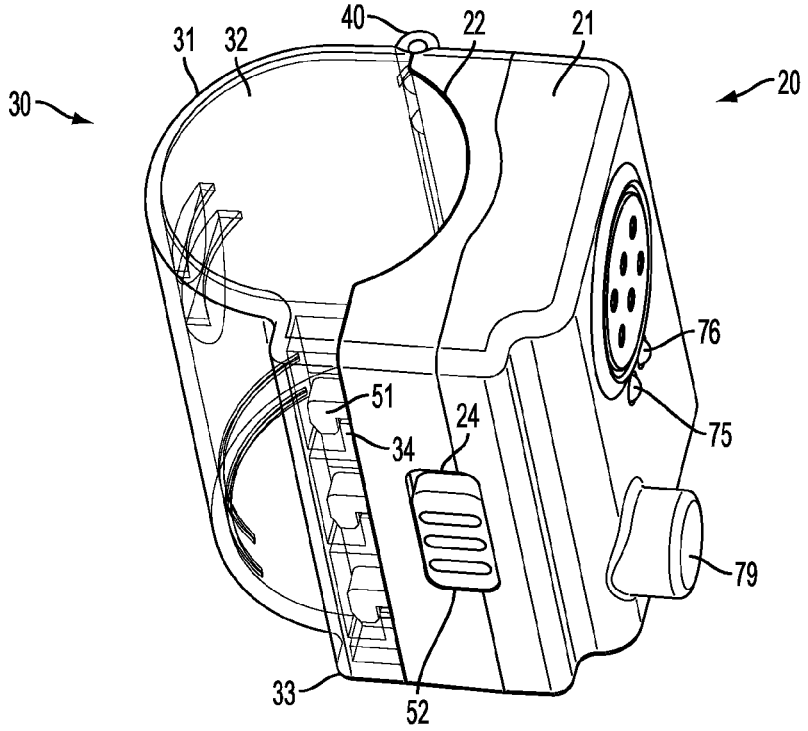
FIG. 2 is a top perspective view of the embodiment an anti-theft tag of FIG. 1 in the closed position.
Figure 3:
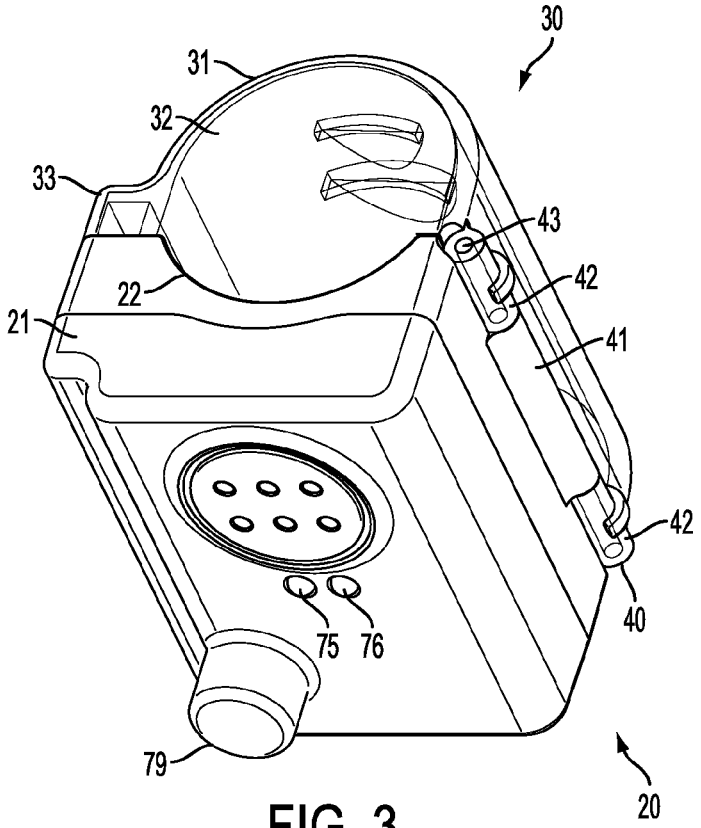
FIG. 3 is another top perspective view of the embodiment of the anti-theft tag of FIG. 1 in the closed position.

FIG. 2 is a top perspective view of the embodiment of anti-theft tag 10 shown in FIG. 1, and FIG. 3 is another top perspective view of the embodiment of anti-theft tag 10 of FIG. 1, both in the closed position. Many features of tag 10 are visible in both FIGS. 2 and 3. In the embodiment of tag 10 shown in FIGS. 2 and 3, first component 20 generally forms a housing 21 for enclosing mechanical and electronic features of tag 10, while second component 30 generally forms a cover 31 complimentary to first component 20 for enclosing the neck 502 of a bottle 500. To that end, first component 20 has a partially cylindrical concave surface 22 facing toward second component 30, and second component 30 is substantially comprised of a partially cylindrical concave shell 31. In the embodiment shown in FIGS. 2 and 3, second component 30 has panel 32 extending across on end of it to enclose one end of the cavity or passageway when first component 20 and second component 30 are in the closed position.

Hinge 40 connects first component 20 and second component 30. Hinge 40 is formed of first hinge component 41, second hinge components 42, and hinge pin 43. First hinge component 41 is actually part of first component 20 and second hinge components 42 are actually parts of second component 30. Hinge pin 43 passes through both first hinge component 41 and second hinge components 42 to hold the two parts together and allow the hinging motion.

In addition to cylindrical concave shell 31, second component 30 has latch receiver 33 along its edge opposite to second hinge components 42. Latch receiver 33 has tabs 34 which can be engaged by hooks 51 of latch 50 when first component 20 and second component 30 are in the closed position. Latch button 52 is used to move latch 50 back and forth.

Figure 4:
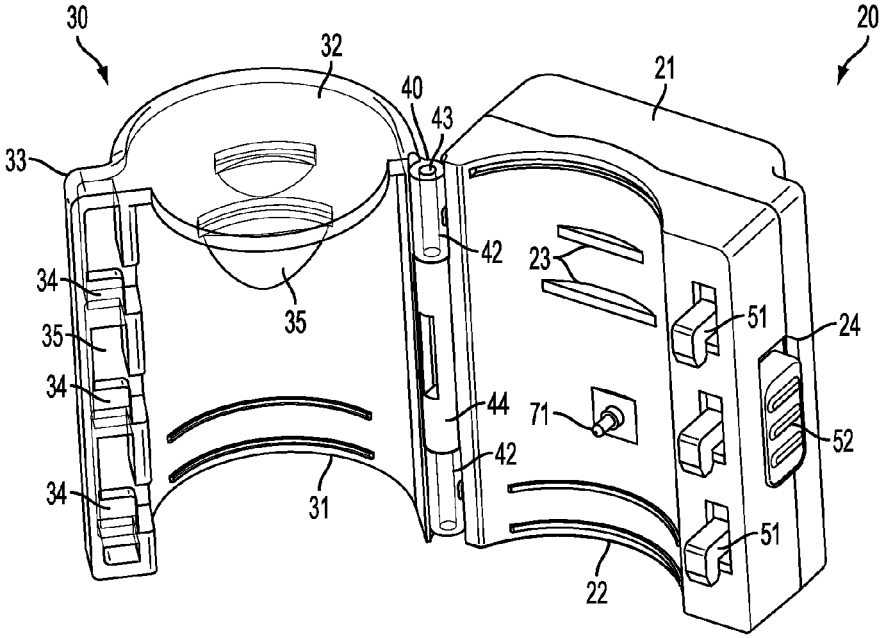
FIG. 4 is a top perspective view of the embodiment of the anti-theft tag of FIG. 1 in an open position.
Figure 5:
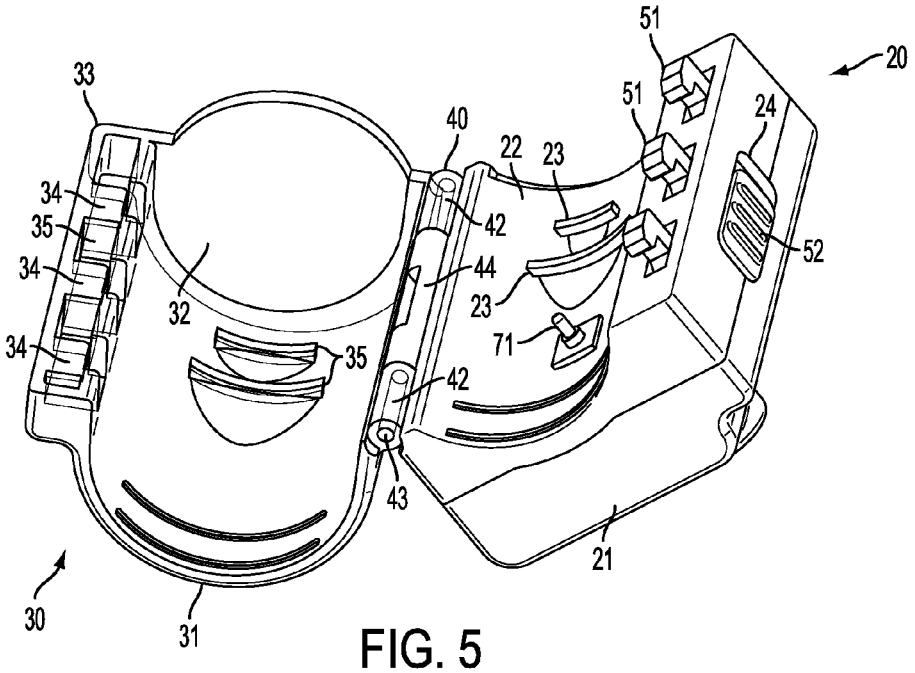
FIG. 5 is a bottom perspective view of the embodiment of the anti-theft tag of FIG. 1 in an open position.

FIGS. 4 and 5 are perspective views of the embodiment of anti-theft tag 10 of FIG. 1 in open positions. FIG. 4 is a top perspective view, while FIG. 5 is a bottom perspective view. With first component 20 and second component 30 of tag 10 pivoted away from each other in open positions, hooks 51 of latch 50 in first component 20 are uncovered. Additionally pockets 35 in latch receiver 33 of second component 30 are clearly visible. Pockets 35 receive hooks 51 when tag 10 is in the closed position and when latch 50 is slid to the engaged, or latched, position, hooks 51 engage tabs 34 to keep tag 10 closed. Housing 21 may enclose a blocking mechanism that keeps latch 50 from being disengaged from tabs 34.

In the embodiment shown in FIGS. 4 and 5, both first component 20 and second component 30 have protrusions, 23 and 35 respectively, on their concave surfaces. Protrusions 23 and 35 extend into the cavity, or passage way, created by tag 10 in the closed position. Protrusions 23 and 35 engage an external feature on a bottle to keep tag 10 from being removed from the bottle. Annular feature 504 of bottle 500 can be seen in FIG. 1 with protrusions 35 engaged with annular feature 504 to retain tag 10 on bottle 500. In some embodiments, tag 10 may have protrusions on only one of its two components. In the bottle 500 shown in FIG. 1, annular feature 504 is a raised ring. However, as mentioned above, the annular feature could take different forms.

Arming switch 72 is visible in both FIGS. 4 and 5. Arming switch 71 is part of the electronics package contained in housing 21 of first portion 20 of tag 10. Arming switch 71 has its state changed by the bottle when tag 10 is closed around a bottle. The change in state of arming switch 71 is part of the arming process for tag 10. When arming switch 71 indicates that tag 10 has been installed on a bottle, tag 10 is ready to be armed by an external device. The external device can activate the security features of tag 10 with wireless communication. The external device can also deactivate or disarm the security features of tag 10. The electronics package may employ additional security features which will be described later.

Figure 8:
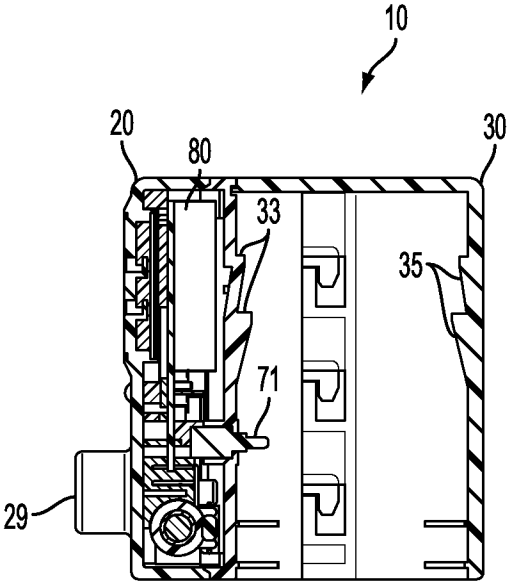
FIG. 8 is a section view of the embodiment of the anti-theft tag of FIG. 1 at section line 8.
Figure 7:
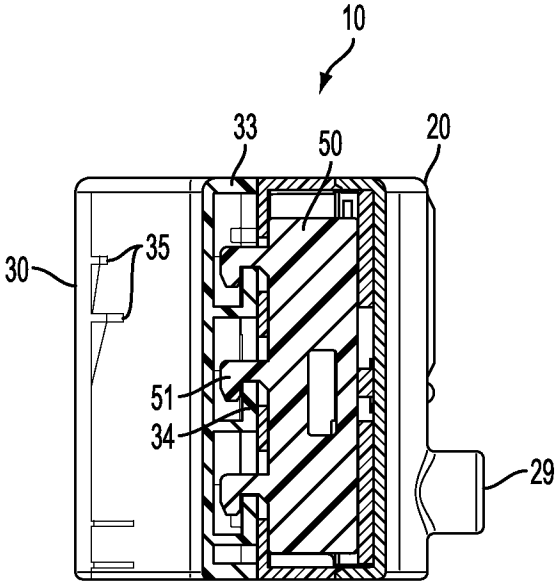
FIG. 7 is a section view of the embodiment of the anti-theft tag of FIG. 1 at section line 7.
Figure 6:
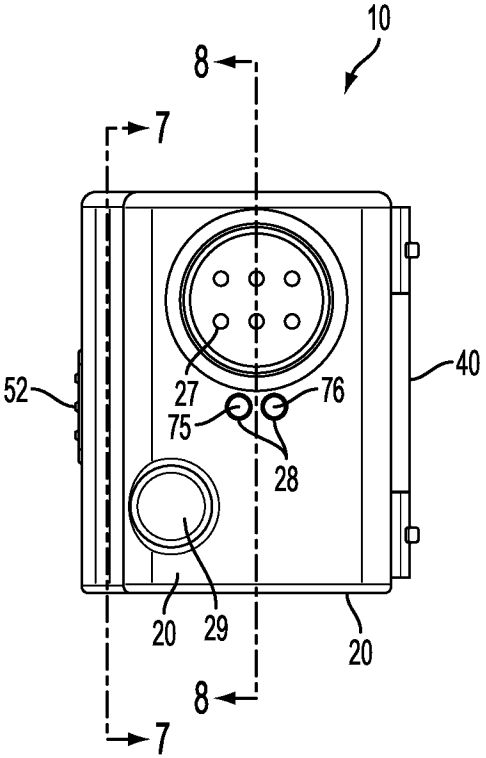
FIG. 6 is a side view of the embodiment of the anti-theft tag of FIG. 1 with section view lines shown.

FIG. 6 is a side view of the embodiment of the anti-theft tag 10 of FIG. 1 with section view lines for FIGS. 7 and 8 shown. FIG. 7 is a section view of anti-theft tag 10 of FIG. 1 at section line 7. FIG. 8 is a section view of anti-theft tag 10 of FIG. 1 at section line 8. In FIG. 7 the section plane cuts through latch 50 and shows the engagement of hooks 51 with tabs 34 of second component 30. In FIG. 8, the section plane cuts through the electronics package and shows a sectional view of arming switch 71 extending out into the passageway in tag 10 for receiving a bottle. Passive EAS element 80 is also shown in FIG. 8.

Figure 9:
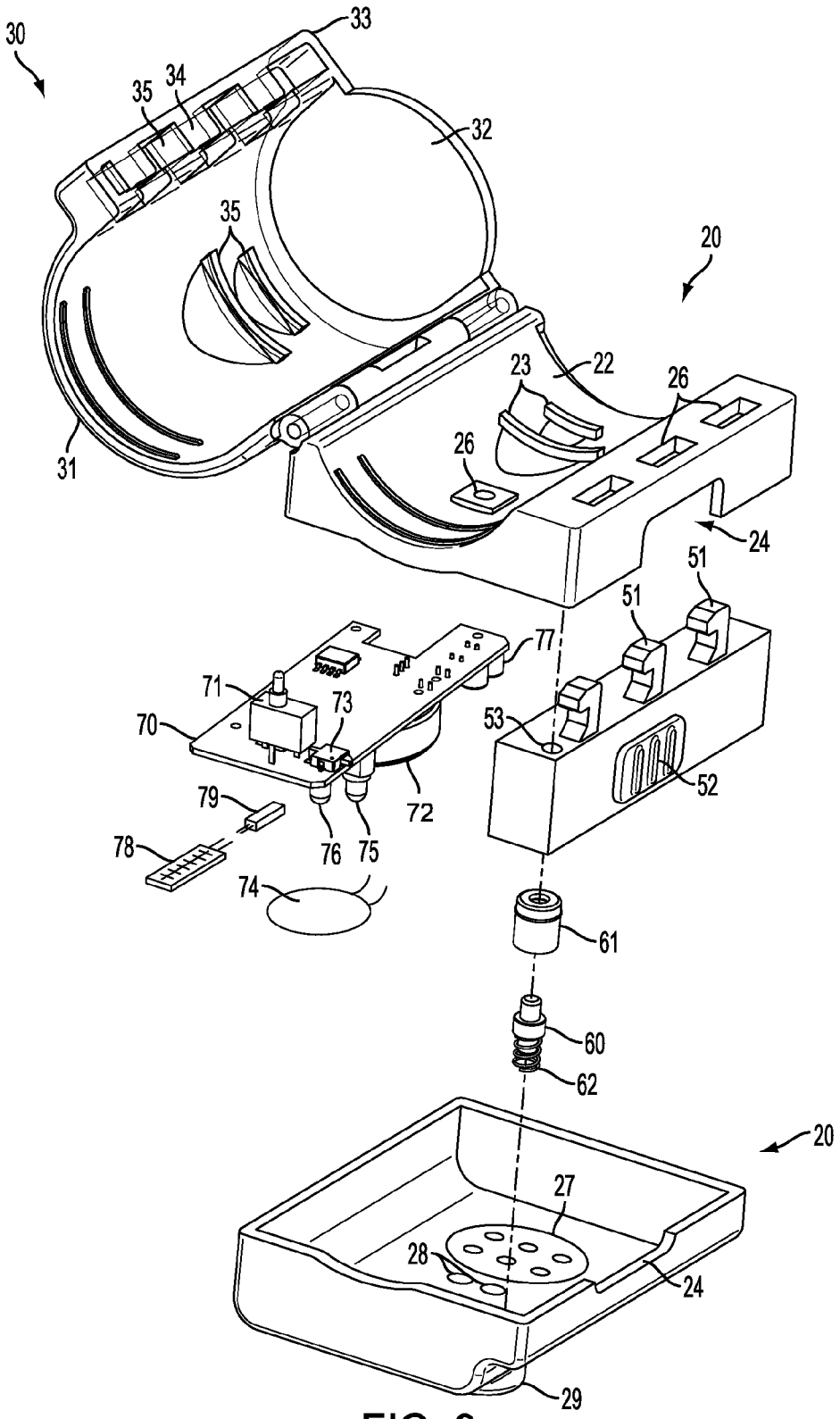
FIG. 9 is a bottom perspective view of the embodiment of the anti-theft tag of FIG. 1 exploded in an open position.

FIG. 9 is a bottom perspective view of anti-theft tag 10 of FIG. 1 exploded in an open position. In FIG. 9, first component 20 is separated into two pieces. In the exploded configuration with internal elements removed, several features of first component 20 are more visible. Switch aperture 26 in concave surface 22 of first component 20 allows arming switch 71 to extend from internal of first component out into the passageway where a bottle fits. Hook apertures 26 allow hooks 51 of latch 50 to pass through the wall of first component 20, while latch button aperture 24 exposes latch button 52 on latch 50. In the embodiment of tag 10 of FIG. 9, latch button aperture 24 is formed by both pieces of first component 20.

In FIG. 9, a first latching component of tag 10, latch 50 is shown more fully. Latch 50 has an elongated body with hooks 51 extending upward from it. When tag 10 is assembled and in the closed position, hooks 51 extend through hook apertures 26 in first component 20 to insert into pockets 35 in the second latch component of tag 10 which is latch receiver 33 of second component 30. Latch button 52 is exposed in latch button aperture 24 of first component 20. Latch button 52 allows latch 50 to be moved back and forth when tag 10 is in the closed position.

As part of a locking mechanism, latch 50 also has a lock aperture 53 at one end. Blocking pin 60, cup 61, and spring 62 complete the locking mechanism. Blocking pin 60 and spring 62 seat in dome 29 of first component 20. Cup 61 seats over blocking pin 60 and spring 62 and maintains blocking pin 60 in position in dome 29. Spring 62 biases blocking pin 60 upward. When latch 50 is slid to engage hooks 51 with tabs 34 of latch receiver 33, spring 62 pushes blocking pin 60 up into lock aperture 53. Blocking pin 60 then blocks movement of latch 50 and keeps it engaged with latch receiver 33. Blocking pin 60 and latch 50 are releasable. Blocking pin 60 is at least partially comprised of a magnetically attractable material. Application of a magnet to dome 29, draws blocking pin 60 down against spring 62, into dome 29, and out of lock aperture 53 in latch 50. With blocking pin 60 withdrawn, latch 50 can be disengaged from latch receiver 33. When latch 50 is in the disengaged position, latch 50 keeps pin 60 recessed in cup 61.

Housing 21 defines an internal compartment, which contains, along with latch 50, an electronics package. Among the electronic elements that may be contained in housing 21 are: circuit board 70; arming switch 71; microprocessor 72; latch switch 73; audible alarm generator 74; infrared communication port 75; light emitting diode 76; battery 77; radio frequency circuitry 78, and a motion detection chip 79. These electronic elements are shown in FIG. 9. A passive EAS element such as a core and coil electronic article surveillance element 80 is shown in FIG. 8.

When tag 10 is assembled, arming switch 71 protrudes through switch aperture 26 in concave surface 22 of first component 20. When tag 10 is in the closed position, arming switch 71 extends out into the cavity or passageway formed by first and second components 20 and 30. If a bottle is present, it changes the state of arming switch 71. The change in the state of arming switch 71 indicates that first component 20 and second component 30 are rotated into a closed position and a bottle is in place. This is detected by circuit board 70 and microprocessor 72. Anti-theft tag 10 may then be armed. The arming of anti-theft tag 10 may be automatic or it may be completed by communication from an external device. In embodiments having latch switch 73, the movement of latch 50 to the engagement position will change the state of latch switch 73. This change in state of latch switch 73 in combination with the prior change in state of arming switch 71 can combine to arm anti-theft tag 10. Other embodiments of anti-theft tag 10 may be armed by communication from an external device.

Communication between anti-theft tag 10 and the external device may be by optical, infrared communication via infrared communication port 75, other wireless communication such as with radio frequency circuitry 78, or other known methods of communication. Once anti-theft tag 10 is armed, if it is removed from the protected bottle without prior disarming communication, the electronics of anti-theft tag 10 will determine an alarm condition and issue an alarm. The alarm may be an audible alarm generated by audible alarm generator 74. The alarm may also be a broadcast alarm broadcast by the communication elements of the electronics of tag 10 to respective receivers in other components of the broader electronic article surveillance system. The broadcast alarm may be broadcast by wireless communications such as infrared communication and radio frequency communication, or other type of communication. Receivers in the broader electronic article surveillance system such as those in base stations, hand held devices, etc. receive the broadcast alarm and can communicate to personnel with screen displays, audible alarms, etc. that an alarm condition has been determined in a tag and to take appropriate action.

In FIGS. 9, 6, 2, and 3 sound apertures 27 are visible. Sound apertures 27 provide direct access of the audible alarm to outside of housing 21. In those same figures optical apertures 28 are also visible. Optical apertures 28 provide visibility to infrared communication port 75 and light emitting diode 76. Infrared communication port 75 provides a route to communicate with EAS tag 10 via infrared communication methods. Light emitting diode 76 provides visual cues for the status of EAS tag 10 and can transmit infrared as well.

Circuit board 70 and microprocessor 72 are capable of storing machine readable instructions and are programmable to monitor the status of EAS tag 10 and to communicate with remote programmers and other elements of an EAS system. Circuit board 70 and microprocessor 72 may be reprogrammed via communication with hand held remotes, or other elements of an EAS system when communicating with these devices. In the embodiment shown in FIGS. 2, 3, and 9 specifically, EAS tag 10 can communicate via infrared communication port 75 and LED 76 and also receive programming instructions.

Audible alarm generator 74 is capable of generating an audible alarm when EAS tag 10 is tampered with, for example, in an attempted unauthorized removal of EAS tag 10, bottle 500 may be separated from tag 10, changing the status of arming switch 71. The change in status of arming switch 71 is detected by circuit board 70 and microprocessor 72 which can determine an alarm status for EAS tag 10 and generate an alarm signal. Audible alarm generator 74 may also be used to indicate the status of EAS tag 10 as it is installed. For example, when first component 20 and second component 30 are rotated to the closed position with bottle 500 in position, bottle 500 contacts arming switch 71, changing its state. Audible alarm generator 74 can produce a sound indicating that EAS tag 10 is installed and ready to be armed by another device such as a handheld remote, or armed by moving latch 50 to the engaged position, which changes the status of latch switch 73. Similarly, LED 76 can be used to provide visual cues for the status of EAS tag 10. Battery 77 generally provides power for the electronic components of EAS tag 10, such as audible alarm generator 74, microprocessor 72, LED 76, etc.

Some embodiments of EAS tag 10 may have an motion detection chip 79 in its electronic package. Motion detection chip 79 detects when the object being protected, bottle 500, is being moved. When motion detection chip 79 detects motion, it signals microprocessor 72 which may be programmed to take specific actions. These actions may include sending query signals out to the broader EAS system, checking for specific field signals from the broader EAS system, as well as other actions. Depending on what it determines upon receiving the signal from motion detection chip 79, microprocessor 72 may determine an alarm condition and generate an alarm.

EAS element 80 is a passive element compatible with prior art EAS systems. These EAS systems generate what is called an interrogation field at a given frequency. These interrogation fields will build up a small amount of stored energy on passive EAS elements brought into the zone. When the interrogation field is turned off and the EAS system listens for a response, the passive EAS elements, such as EAS element 340, dissipate their energy and generate a signal at a designed frequency. The EAS system is capable of detecting the signal as an indication of the unauthorized presence of the passive elements and can generate an alarm based on the signal. The EAS element 80 contained within the embodiment of EAS tag 10 in FIG. 8 is compatible with prior art and legacy systems providing an additional security mechanism. In addition to the prior art system detection of the passive EAS element 80, in some embodiments circuit board 70 and microprocessor 72 can monitor the status of passive element 80 and issue an alarm as well. If microprocessor 72 or circuit board 70 detect energy storage and dissipation activity in the coil, then audible alarm generator 74 may be instructed to generate an alarm or the communication capabilities of the electronics may be employed to broadcast a signal to respective receivers in the broader EAS system to generate an alarm. While the passive EAS element 80 shown in FIG. 8 is shown as a core and coil type of element, any passive element known in the art could be used.

The electronics of some embodiments of EAS tag 10 may have passcode protection. These embodiments are capable of storing a passcode which is required to be matched by remote devices and detachers for various communications to be verified as authorized. For further protection the electronics of some embodiments of EAS tag 10 may include a clock generator and the electronics may have machine readable instructions with an algorithm to change the passcode at preprogrammed time intervals. The EAS system, including handheld remotes, also has at least one clock generator and is capable of updating the passcode at the preset intervals to update the system's record of the passcode. This keeps the passcode between EAS tag 10 and the rest of the EAS system synchronized.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. An anti-theft tag for bottles having a neck and an annular feature about said neck proximal to the end of said bottle, said anti-theft tag comprising:

a first component hingably connected to a second component, said first and second components rotatable between open and closed positions and, when in said closed position, defining a passageway for enclosing the neck of a bottle to be protected, one of said first component and said second component having a first protrusion extending into said passageway;

said first component, comprising a first latching component and a housing defining an internal compartment with a switch aperture in said passageway passing from said internal compartment to external of said housing;

electronics located within said internal compartment, said electronics comprising an arming switch having two states, an open state and a closed state, said arming switch extending through said switch aperture in said housing out into said passageway;

said second component comprising a second latching component;

said neck of said bottle changing the state of said arming switch when said first component and said second component are rotated to said closed position about said neck of said bottle, said first and second latching components combining to maintain said first and second components in said closed position when said latching components are engaged, and said first protrusion engaging said annular feature to maintain said tag on said bottle.

2. The anti-theft tag of claim 1, wherein:

said latching components are releasably lockable in engagement.

3. The anti-theft tag of claim 2, wherein:

said releasably lockable latching components may be unlocked by application of a magnet.

4. The anti-theft tag of claim 1, wherein:

said first latch component is a manually operated sliding latch movable between an engaged position and a disengaged position;

said anti-theft tag further comprising a biased blocking component, said biased blocking component moving to a blocking position when said sliding latch is manually slid to said engaged position, thereby blocking the return of said sliding latch;

said biased blocking component being movable to a non-blocking position by application of a magnet to a magnetically attractable element associated with said biased blocking component, the moving of said biased blocking component to a non-blocking position allowing said sliding latch to be manually moved to said disengaged position.

5. The anti-theft tag of claim 1, wherein:

said electronics further comprise a circuit board, a microprocessor, communication elements, an audible alarm generator, and a battery.

6. The anti-theft tag, of claim 5, wherein:

if said, electronics detect a change in the status of said arming switch without authorizing communication being received by said communication elements in said electronics, said electronics determine an alarm condition and generate an alarm.

7. The anti-theft tag of claim 6, wherein;

said alarm is an audible alarm.

8. The anti-theft tag of claim 6, wherein;

said alarm is an alarm signal broadcast by said communication elements for receipt by devices external to said anti-theft tag.

9. The anti-theft tag of claim 5, wherein;

said electronics further comprise a latch switch;

said latch changing the state of said latch switch and arming said tag when said first and second components are in said closed position and said latch is moved to said engaged position.

10. The anti-theft tag of claim 5, wherein;

said communication elements are capable of communicating with external devices to receive signals changing said anti-theft tag between armed and disarmed states.

11. The anti-theft tag of claim 5, further comprising:

machine readable instructions encoded in said microprocessor for storing a passcode.

12. The anti-theft tag of claim 11, wherein:

said electronics further comprise an accurate clock generator, and said machine readable instructions further comprise an algorithm for generating multiple passcodes, wherein at specific time intervals said algorithm generates a new passcode and a previously stored passcode is replaced by said new passcode.

13. The anti-theft tag of claim 1, further comprising;

a passive electronic article surveillance element.

14. The anti-theft tag of claim 1, further comprising;

a panel extending from one of said first component and said second component, said panel extending over one end of said passageway when said first component and said second component are in said closed position, and when said tag is attached to a bottle said panel enclosing the end of said bottle.

15. The anti-theft tag of claim 1, further comprising;

a second protrusion on the other of said first component and said second component said second protrusion also extending out into said passageway and engaging said annular feature of said bottle.

* * * * *